United States Patent [19]

Munnich

[11] 4,141,181

[45] Feb. 27, 1979

[54] HOLDING DISK FOR A BORELESS GRINDING WHEEL

[75] Inventor: Hermann Munnich, Bad Kissingen, Fed. Rep. of Germany

[73] Assignee: SKF Kugellagerfabriken GmbH, Schweinfurt, Fed. Rep. of Germany

[21] Appl. No.: 779,694

[22] Filed: Mar. 21, 1977

[30] Foreign Application Priority Data

Mar. 23, 1976 [DE] Fed. Rep. of Germany ... 7608858[U]

[51] Int. Cl.[2] ..... B24B 41/00

[52] U.S. Cl. ..... 51/168

[58] Field of Search ..... 51/168, 170 T, 170 PT, 51/379, 389, 390, 377, 378, 358, 209 R

[56] References Cited

U.S. PATENT DOCUMENTS

| | | | |
|---|---|---|---|
| 212,549 | 2/1879 | Gear | 51/168 |
| 2,501,554 | 3/1950 | Watson | 51/378 |
| 3,136,100 | 6/1964 | Robertson, Jr. | 51/378 |
| 3,667,170 | 6/1972 | Mackay, Jr. | 51/389 |
| 3,707,059 | 12/1972 | Burtch | 51/389 |

FOREIGN PATENT DOCUMENTS

| | | | |
|---|---|---|---|
| 790147 | 2/1958 | United Kingdom | 51/168 |

*Primary Examiner*—Harold D. Whitehead
*Assistant Examiner*—Roscoe V. Parker
*Attorney, Agent, or Firm*—Daniel M. Rosen

[57] ABSTRACT

A holding disk, having, in the center, a sleeve-shaped section provided with a thread and, at the outer periphery, an annular flange running in radial direction and displaced axially in relation to the sleeve-shaped section. The connecting section between the sleeve-shaped section and the annular flange joining the end of the sleeve-shaped section is turned away from the annular flange.

15 Claims, 2 Drawing Figures

HOLDING DISK FOR A BORELESS GRINDING WHEEL

This invention relates to a holding disk, and particularly, to a holding disk made of sheet metal for attachment by means of adhesive to a boreless grinding wheel.

A conventional holding disk is known which lends itself to simple and inexpensive mass production. In the conventional construction, the known holding disk has such little thickness that its material value is virtually insignificant, thus allowing it to be discarded along with the used grinding wheel associated therewith. This known holding disk is made of sheet metal coated with synthetic thermoplastic material, and formed by punching, pressing or stamping. It has an annular flange and an elevated center part which is provided with openings serving for fastening the holder to a drive member. For attaching the grinding wheel to the holder, the wheel is bonded by the synthetic material to the holder using heat and pressure.

In this known embodiment, however, the holder has been found to not have sufficient strength to be used at high grinding speeds and with high grinding forces.

It is, therefore, the prime object of the present invention to obtain a holder lending itself to simple and inexpensive mass production which may use thin-walled material and yet be sufficiently rigid and strong at high grinding speeds and with high grinding pressure.

It is a further object of the present invention to provide a holder with means ensuring rapid but, nevertheless, durable attachment to the drive member.

It is a still further object of the present invention to provide a holding disk construction which may be satisfactorily centered.

The foregoing objects are accomplished by providing a holding disk having, in the center, a sleeve-shaped section provided with a thread and, at the outer periphery, an annular flange running in radial direction and displaced axially in relation to the sleeve-shaped section. The connecting section between the sleeve-shaped section and the annular flange joining the end of the sleeve-shaped section is turned away from the annular flange.

In accordance with the invention, the foregoing design imparts to the holding disk a cross-sectional shape that is very strong. This strength may, according to an additional feature of the invention, be augmented by providing the annular flange with stiffening corrugations or the like running in radial direction and distributed at the periphery.

The exact centering of the holding disk is achieved, pursuant to an additional feature of the invention, by a ground face and conical centering. For this purpose the sleeve-shaped section is provided near a ground face with a toroidal shoulder or is itself designed as a conical shoulder. As a result, a plastic-elastic deformation is achieved, thereby preventing any static redundancy.

Figure 1:
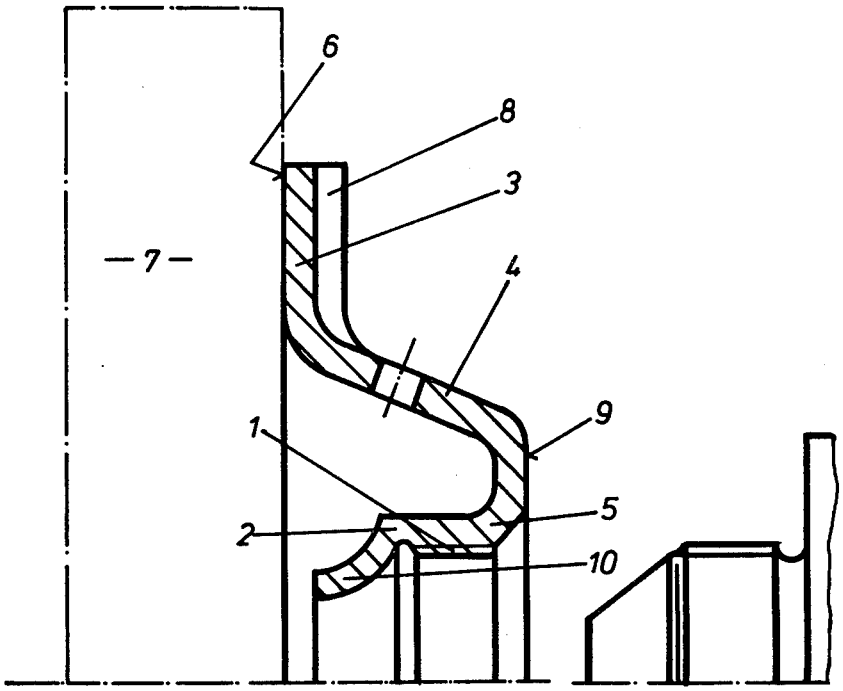
Figure 2:
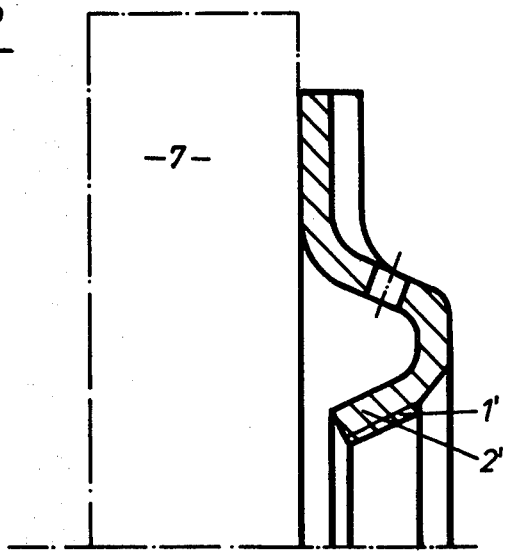

The foregoing objects and brief description wil become more apparent from the following more detailed description and appended drawings, wherein:

FIG. 1 illustrates a section of the holding disk of the present invention having a cylindrical attachment section, and FIG. 2 illustrates a section of the holding disk having a conical attachment section.

The holding disk of FIG. 1 has, in the center, a sleeve-shaped cylindrical section 2 provided with a thread 1 and, on the outer periphery, an annular flange 3 running in radial direction and displaced axially in relation to the sleeve-shaped section 2. The two parts are connected by a connecting section 4, which runs conical in cross-section and connects with the sleeve-shaped section 2, at its end 5, and turned away from the annular ring flange. This cross-sectional shape of the holding disk makes the latter, despite the thin-walled material used, sufficiently stable and rigid so that the boreless grinding wheel 7, (indicated by dash-and-dot lines) attached in known manner by adhesive on the face 6 of the annular flange 3, may alternatively be employed for high and very high speeds, as well as with high grinding pressures. To stiffen the radial flange 3 of the holding disk, reinforcing corrugations 8 or the like, running in radial direction, may be provided, as represented in the example.

With the aid of the inner thread 1, the holding disk with the mounted grinding wheel may be screwed onto a drive spindle or the like.

Centering of the holding disk represented in FIG. 1 is achieved by fitting the ground face 9 against the shoulder of the grinding spindle and by fitting the toroidal shoulder 10 against a cone of the grinding spindle. Any static redundancy is prevented by plastic-elastic deformation of the toroidally-shaped inner surface.

In the embodiment of FIG. 2 a conical attachment section 2' having a similarly configured conical thread 1' is provided in the center of the holding disk. In other respects this holding disk corresponds largely to the embodiment of FIG. 1. It is, however, evident from the figures that in the embodiment of FIG. 2 the axial width is smaller than that shown in FIG. 1. In this embodiment the radial centering is produced by the conical thread. Any static redundancy is also prevented here by elastic-plastic deformation of the threaded attachment section 2'.

The holding disks pursuant to the invention thus lend themselves to simple and cheap production out of thin-walled sheet metal. Despite their slight thickness and hence their insignificant material value, they are sufficiently stable and rigid so that they may alternatively be used for high grinding speeds and with high grinding pressures.

What is claimed is:

1. A sheet metal holding disk adapted for attachment to a boreless grinding wheel, having in the center, a sleeve-shaped section provided with a thread adapted to be coupled to a drive means and, at the outer periphery, an annular flange adapted for attachment to said boreless grinding wheel, said flange extending in the radial direction in a transverse plane displaced axially toward the position of said grinding wheel in relation to all portions of said sleeve-shaped section, and a connection section joining an end of said annular flange to the end of said sleeve-shaped shoulder most remote from said plane.

2. The holding disk of claim 1, wherein said annular flange is provided with stiffening means running in a radial direction and distributed on the periphery thereof.

3. The holding disk of claim 1, wherein said connecting section has a surface ground face for conical centering.

4. The holding disk of claim 3, wherein said sleeve-shaped section is cylindrical and has a toroidally-shaped radially inwardly extending shoulder at the end thereof toward said plane.

5. The holding disk of claim 3, wherein said sleeve-shaped section is conical.

6. The holding disk of claim 3, wherein said attachment is effected by thermoplastic bonding, thermoplastic bonding means being placed on the face of said flange toward the position of said grinding wheel.

7. The holding disk of claim 1 wherein said connection section includes a planar annular section parallel to said plane and defining the surface of said holding disk most remote from said plane.

8. The holding disk of claim 1 wherein said sleeve-shaped section is cylindrical, and has a toroidally-shaped radially inwardly extending shoulder at the end thereof toward said plane.

9. The holding disk of claim 7 wherein said sleeve-shaped section is conical, having a decreasing diameter toward said plane.

10. A grinding wheel assembly comprising a boreless grinding wheel and a sheet metal holding disk affixed coaxially on one side of said grinding wheel; one side of said grinding wheel extending in a plane normal to the axis of rotation of said wheel, said disk having a central axially extending sleeve with internal threads for attachment to a drive means, an annular flange at its outer periphery and affixed to said one side of said wheel, said flange extending radially in said plane, all portions of said sleeve being axially displaced from said wheel and a connection section extending between an end of said flange and the end of said sleeve most remote from said wheel.

11. The grinding assembly of claim 10 wherein said connection section extends between the radially innermost edge of said flange and said end of said sleeve away from said wheel.

12. The grinding assembly of claim 11 wherein the portion of said connection section most remote from said wheel defines a face in a plane parallel to the plane of said side of said grinding wheel.

13. The grinding wheel assembly of claim 11 wherein said face is a ground face.

14. The grinding wheel assembly of claim 13 wherein said sleeve is frustoconical, whereby said threads are frustoconical.

15. The grinding wheel assembly of claim 13 wherein said sleeve has a toroidal shoulder on the end thereof toward said grinding wheel, said shoulder extending radially inwardly from said sleeve.

* * * * *

UNITED STATES PATENT AND TRADEMARK OFFICE

CERTIFICATE OF CORRECTION

PATENT NO. : 4,141,181
DATED : February 27, 1979
INVENTOR(S) : Hermann Munnich

It is certified that error appears in the above-identified patent and that said Letters Patent are hereby corrected as shown below:

Column 2, line 13, delete "radial" and insert --radially extending annular--.

Column 2, line 16, omit " . " and insert --in Fig. 1. --.

Column 2, line 27, after"FIG. 2" insert --,--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*